United States Patent [19]

Lehmann

[11] Patent Number: 4,494,665

[45] Date of Patent: Jan. 22, 1985

[54] DEVICE FOR PREVENTING THE SELF-UNSCREWING OF A CAP FROM A CONTAINER

[75] Inventor: Myrtil B. Lehmann, Saint-Cloud, France

[73] Assignee: Chanel, Neuilly-sur-Seine, France

[21] Appl. No.: 459,594

[22] Filed: Jan. 20, 1983

[30] Foreign Application Priority Data

Jan. 22, 1982 [FR] France ..... 82 00973

[51] Int. Cl.[3] ..... B65D 41/04

[52] U.S. Cl. ..... 215/330

[58] Field of Search ..... 215/330

[56] References Cited

U.S. PATENT DOCUMENTS

| | | | |
|---|---|---|---|
| 2,162,880 | 6/1939 | Brown . | |
| 2,684,168 | 7/1954 | McGinnis et al. | 215/330 |
| 2,827,193 | 3/1958 | Martin . | |
| 3,295,708 | 1/1967 | Wathen, Jr. . | |
| 3,297,185 | 1/1967 | Plymale | 215/330 |
| 3,435,978 | 4/1969 | Wittwer . | |
| 3,682,345 | 8/1972 | Baugh | 215/330 |
| 4,093,096 | 6/1978 | Augros | 215/330 |
| 4,289,248 | 9/1981 | Lynn | 215/330 |

FOREIGN PATENT DOCUMENTS

| | | | |
|---|---|---|---|
| 2318795 | 2/1977 | France . | |
| 805593 | 12/1958 | United Kingdom | 215/DIG. 1 |
| 812090 | 4/1959 | United Kingdom | 215/DIG. 1 |
| 2035972 | 6/1980 | United Kingdom | 215/330 |

*Primary Examiner*—Donald F. Norton

*Attorney, Agent, or Firm*—Armstrong, Nikaido, Marmelstein & Kubovcik

[57] ABSTRACT

A device for preventing the self-unscrewing of a screw cap from a container, e.g. a bottle for use in pharmacy or perfumery and typically containing a volatile liquid product. The container has a neck having formed thereon a screwthread and a projection at or below the lower end of the neck screwthread. The cap screwthread has such a length that, during screwing of the cap onto the neck, the front or lower end of the cap screwthread strikes against the projection when the inside surface of the top portion of the cap is in contact with the top end of th neck. Final screw tightening of the cap causes the front or lower end of the cap screwthread to ride over the projection so that the cap is held more securely in a tightened condition on the container neck.

5 Claims, 3 Drawing Figures

DEVICE FOR PREVENTING THE SELF-UNSCREWING OF A CAP FROM A CONTAINER

BACKGROUND OF THE INVENTION

1. Technical Field

This invention relates to a device for preventing the self-loosening or self-unscrewing of a screw cap from a screwthreaded neck of a container, e.g. a bottle.

2. Description of the Prior Art

It is known that during the filling of screw top bottles with a liquid product the screwthread formed on the neck of the bottle often becomes wetted with the liquid product. The presence of the liquid product between the neck of the bottle and the cap has the effect of lubricating the screwthread connection between the neck and the cap with the consequence that during transport of such bottles, particularly over long distances, the caps are able to work themselves loose. As a result of this self-unscrewing of the caps, part of the liquid product contained in the bottles is able to escape from the bottles. In addition to the actual loss of the liquid product, the escaping liquid product may also possibly damage the bottle packaging. This is particularly evident when the packaging material is able to absorb the liquid product causing the packaging to become stained and giving it a doubtful appearance. The loss of the liquid product from a bottle and/or the staining of a bottle's packaging material will of course necessitate the withdrawal from sale of such a bottle.

One object of the present invention is therefore to provide a device for avoiding the spontaneous or self-unscrewing of a cap from a container, e.g. a bottle.

Another aim of the present invention is to provide a screw top bottle which, when filled with a liquid product, retains its saleable value.

SUMMARY OF THE INVENTION

According to one aspect of the present invention there is provided a container comprising a neck defining an access opening and having thereon first screwthreaded means and projection means at or below the bottom of the first screwthreaded means, and a removable cap having a top portion and a skirt portion provided on its internal surface with inwardly projecting, second screwthreaded means for cooperating with the first screwthreaded means during screwing of the cap onto and off from the neck, the second screwthreaded means having such a length and the projection means being so positioned that the latter blocks the downward helical advance of the front end of the second screwthreaded means around said neck, during screwing of the cap onto the neck, after the top portion of the cap contacts the top end of the neck, whereby the application of a final screw tightening force to the cap causes the front end of said second screwthreaded means to ride over the projection means and the top portion of the cap to be pressed more firmly against the top end of the neck.

Throughout this specification it will be assumed that the container is in an upright condition with the neck at the top end of the container and extending substantially vertically upwards. The terms "top", "bottom", "below" and "downward" used in this specification are to be construed accordingly. Of course the invention is not intended to be limited solely to containers which, in their normal standing positions, have vertically upwardly extending necks.

Advantageously the projection means comprises a protuberance which extends substantially vertically.

Preferably the projection means extends upwardly from a check ring which is typically located near the base of the container neck.

According to another aspect of the present invention there is provided a device for avoiding the self-unscrewing of a cap from a container having a neck provided with a first screwthread and a projection at or beneath the bottom of the first screwthread, the said cap having a second screwthread of a length such that, on screwing the cap onto the neck, its lower end strikes against the projection when the top of the cap is in contact with the top end of the neck, the said second screwthread being movable over the projection on the application of a further screw tightening force to the cap.

BRIEF DESCRIPTION OF THE DRAWING

The invention will now be described, by way of example, with reference to the accompanying drawing, in which.

DESCRIPTION OF THE PREFERRED EMBODIMENTS

Figure 1:
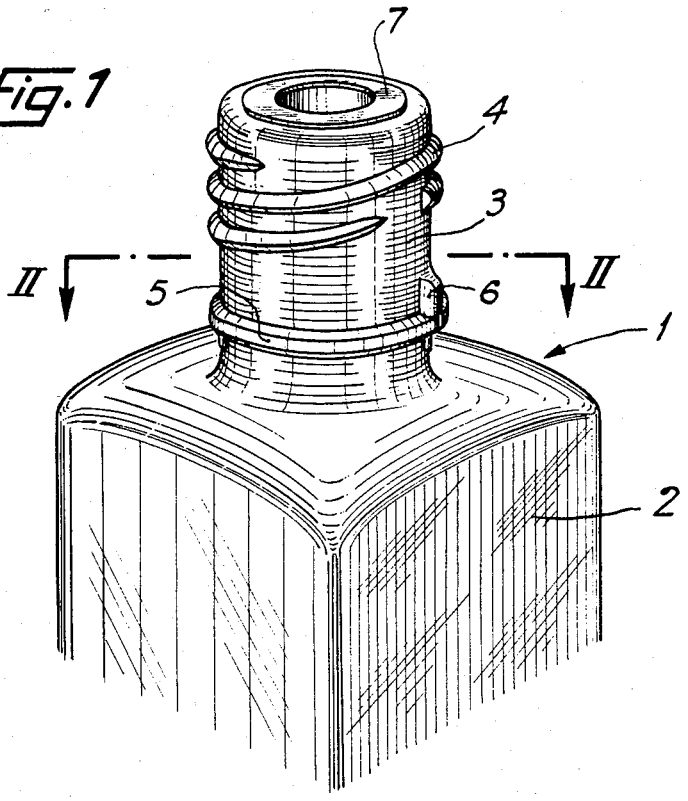
FIG. 1 is a perspective view of part of a container according to the invention.
Figure 2:
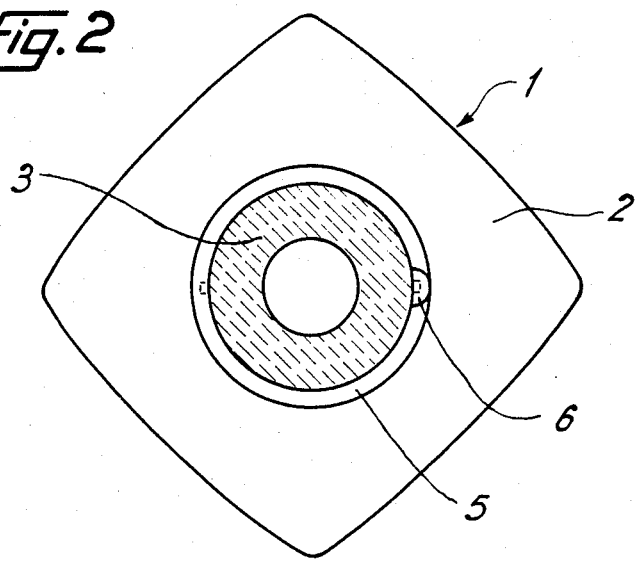
FIG. 2 is a view taken on the line II—II of FIG. 1.

FIGS. 1 and 2 show a bottle, generally designated by the reference numeral 1, provided with a device according to the present invention and comprising a body 2 and a neck 3. The neck 3 has a screwthread 4 on which a cap (not shown) is to be screwed. The screwthread 4 may be continous, or may, as shown in FIG. 1, have one or more discontinuities therein.

A check ring 5 is provided near the base of the neck 3 and a projection 6, in the form of a vertically extending protuberance, is positioned immediately above the ring 5. It is not essential for the projection to be positioned immediately above the check ring 5. Instead the projection 6 may be positioned at or adjacent the bottom end of the screwthread 4 or at any other region on the neck below the bottom end of the screwthread 4 (and above the check ring 5 if the latter is provided).

The cap for the bottle 1 has a top portion and a skirt portion depending downwardly therefrom. Formed on the inside of the skirt portion there is provided inwardly projecting means defining a cap screwthread for cooperation with the screwthread 4 during screwing of the cap onto and off from the neck 3. The cap screwthread has such a helical extent that its lower or front end, during screwing of the cap onto the neck 3, first strikes against the projection 6 as it advances in a helical path downwardly and around the neck 3 when the top portion of the cap is in contact with the upper end of the neck 3. In order to provide a liquid seal between the top portion of the cap and the neck an annular seal is provided therebetween, e.g. either on the inside surface of the top portion of the cap or, as shown in FIG. 1, on the annular top surface of the neck 3. On the application of a further screw tightening force to the cap, the front or lower end of the cap screwthread is caused to ride over the projection 6 and presses against a region of the cap screwthread adjacent the lower end thereof. The pressing of the projection 6 against the cap screwthread secures the cap more securely on the neck 3 so that there is much less of a tendency for the cap to unscrew itself from the neck of the bottle 1. Overtightening of the cap on the neck 3 is prevented by the check ring 5 which prevents the lower annular surface of the skirt portion of the cap from being moved downwardly therepast.

Figure 3:
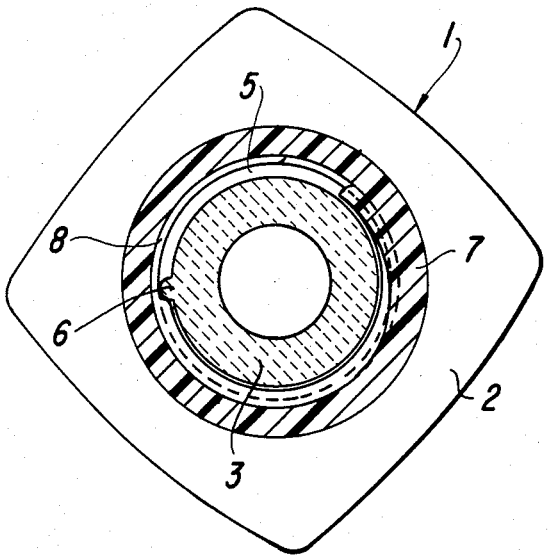
FIG. 3 is a view taken on the line II—II of FIG. 1 with the cap in place.

As shown in FIG. 3, when the cap 7 is secured to the bottle neck 3 to the point where it meets projection 6, further tightening causes the inner portion of the screwthread 8 to ride over the projection 6. This portion of the screwthread presses tightly against projection 6 so that the cap cannot self-unscrew from the bottle.

Of course it is not essential for the inwardly projecting means defining the cap screwthread to be in the form of a continous helix. It is possible for one or more discontinuities to be provided in the cap screwthread. If such a discontinuity is provided in the cap screwthread it is possible for the projection 6 to be located in the cap screwthread discontinuity after the application of the final screw tightening force to the cap.

The present invention has applications in many different fields although it is primarily concerned with bottles for use in the perfumery and pharmacy fields. Of course bottles containing perfume or pharmacy products often contain volatile liquids.

As mentioned previously the invention is intended to cover containers other than bottles and containers of any shape. The invention may also be modified in any way within the scope of the appended claims.

What we claim is:

1. A container comprising:

a neck having therein an access opening;

first screwthread means formed on said neck and extending downwardly from the vicinity of said opening;

an annular check ring formed on said neck below said first screwthread means; and a projection means formed integral with and extending upwardly from said annular check ring toward said first screwthread means, said projection means being so positioned that when a screw cap is fully engaged on said first screwthread means, the lower portion of said screw cap will press against said projection means and thereby secure said screw cap on said container neck.

2. A container comprising:

a neck having therein an access opening;

first screwthread means formed on said neck and extending downwardly from the vicinity of said opening;

an annular check ring formed on said neck below said first screwthread means;

a projection means formed on said annular check ring and extending upwardly therefrom; and a screw cap having second screwthread means formed therein for engaging said first screwthread means, said screw cap being so formed that when said second screwthread means fully engage said first screwthread means, a portion of said second screwthread means will ride over said projection means and press tightly against said projection means, thereby securing said screw cap on said container.

3. A container as recited in claim 1 or claim 2 further comprising an annular resilient seal around said access opening, said seal being formed so as to resiliently compress against said screw cap when said screw cap is fully engaged on said first screwthread means.

4. A container as recited in claim 1 or claim 2 wherein said projection extends vertically from said annular check ring.

5. A container comprising:

a neck having an access opening therein;

first screwthread means formed on said neck and extending downwardly from the vicinity of said opening;

an annular check ring formed on said neck below said first screwthread means;

a screw cap having second screwthread means formed therein for engaging said first screwthread means, said second screwthread means being formed to extend below said first screwthread means when said screw cap is fully engaged on said container neck; and a projection means formed on said neck integral with and extending vertically upward from said check ring along said neck below said first screwthread means, said projection means being positioned so that a portion of said second screwthread means will ride over said projection means and be pressed thereby when said screw cap is fully engaged on said container neck, whereby said screw cap will be secured on said container neck.

* * * * *